US009004322B2

(12) United States Patent
Graham

(10) Patent No.: US 9,004,322 B2
(45) Date of Patent: Apr. 14, 2015

(54) VERTICAL SPRAY BOTTLE FOR APPLICATION OF LIQUID TO A HORIZONTAL SURFACE

(71) Applicant: Nicholas Christian Graham, Goldsboro, NC (US)

(72) Inventor: Nicholas Christian Graham, Goldsboro, NC (US)

( * ) Notice: Subject to any disclaimer, the term of this patent is extended or adjusted under 35 U.S.C. 154(b) by 3 days.

(21) Appl. No.: 13/786,827

(22) Filed: Mar. 6, 2013

(65) Prior Publication Data

US 2013/0341361 A1 Dec. 26, 2013

Related U.S. Application Data

(60) Provisional application No. 61/664,164, filed on Jun. 26, 2012.

(51) Int. Cl.
*B05B 11/00* (2006.01)

(52) U.S. Cl.
CPC ..... *B05B 11/3046* (2013.01); *B05B 11/0059* (2013.01); *B05B 11/3011* (2013.01)

(58) Field of Classification Search
CPC ..... B05B 11/3011; B05B 11/3012; B05B 11/3015; B05B 11/0059; B05B 11/3057
USPC ..... 222/383.1, 382, 402.19, 402.9, 372, 222/373, 375–377, 380, 401
See application file for complete search history.

(56) References Cited

U.S. PATENT DOCUMENTS

| | | | | |
|---|---|---|---|---|
| 5,119,974 | A * | 6/1992 | Mann | 222/376 |
| 5,341,967 | A * | 8/1994 | Silvenis | 222/376 |
| 5,542,581 | A * | 8/1996 | Habora et al. | 222/331 |
| 5,624,060 | A * | 4/1997 | Ellion et al. | 222/376 |
| 5,875,933 | A * | 3/1999 | Ellion et al. | 222/189.1 |
| 6,027,041 | A * | 2/2000 | Evans | 239/334 |
| 6,179,170 | B1 * | 1/2001 | Bachand | 222/402.19 |
| 6,394,319 | B1 * | 5/2002 | Pucillo | 222/383.1 |
| 6,443,332 | B1 * | 9/2002 | Costea | 222/321.1 |
| 6,732,958 | B2 * | 5/2004 | Norville et al. | 239/582.1 |
| 6,834,815 | B2 * | 12/2004 | Appleby | 239/334 |
| 7,775,401 | B2 * | 8/2010 | Banco et al. | 222/136 |
| 2005/0133626 | A1 * | 6/2005 | Hornsby et al. | 239/380 |
| 2009/0140011 | A1 * | 6/2009 | Olson et al. | 222/380 |
| 2011/0180100 | A1 * | 7/2011 | Hafer et al. | 134/6 |

* cited by examiner

*Primary Examiner* — Paul R Durand
*Assistant Examiner* — Charles P Cheyney

(57) ABSTRACT

A hand held spray bottle for use in the downward application of a liquid onto a horizontal surface. The spray bottle generally comprises a liquid spray device and a liquid storage bottle with an open threaded top to which the spray device is attached. The liquid spray device contains an internal pump assembly, trigger, and nozzle.

7 Claims, 6 Drawing Sheets

VERTICAL SPRAY BOTTLE FOR APPLICATION OF LIQUID TO A HORIZONTAL SURFACE

This invention relates in general to spray bottles and in particular, to those spray bottles used to dispense common cleaning fluids, and claims the benefit of provisional patent 61/664,164.

BACKGROUND OF THE INVENTION

The majority of cleaning fluids for household use is sold in plastic spray bottles, consisting of a bottle body with a threaded opening at the top, connected to a spray device which includes a siphon straw, trigger and pump assembly, and spray nozzle. The majority of these cleaning fluids are intended to clean horizontal surfaces (countertops, carpets, floors). To apply the spray to a horizontal surface, the user will tilt the spray bottle at an angle so the nozzle directs the spray downward. When the fluid in the bottle reaches a low level and a user attempts to apply the fluid to a horizontal surface, the bottom of the siphon straw will not remain in contact with the remaining fluid and will draw air into the straw. The user will then hold the bottle vertically to put the siphon straw in contact with the remaining fluid, prime the straw and pump with several trigger squeezes, then aim the spray nozzle downward to apply the fluid. With one or two trigger squeezes, the pump and straw are now empty, and the user will re-prime. This process is inefficient. Additionally, there will always be a small volume of liquid remaining in the bottle that the user is unable to spray, due to the siphon straw not extending to the absolute bottom of the bottle, and also due to the bottle bottom's flat shape, which spreads the remaining fluid out over the entire bottle bottom surface.

DISCUSSION OF PRIOR ART

Due to their common usage in household cleaning, spray bottles represent a large economic market. In response to this opportunity, numerous inventors have designed patents attempting to increase the spray bottle's functionality. Smith, in U.S. Pat. No. 5,526,963, "HAND-HELD GRAVITY FEED SPRAY BOTTLE", 18 Jun. 1996, discloses one such device. This innovation, which places the bottle above the spray device, has several inherent problems. The trigger actuated spray device is angled for a primary use of directing the spray horizontally. I have found that if a user desires to spray the liquid down, the spray device will be held at an extreme angle with the bottle's center of gravity extending laterally well beyond the hand grip and trigger, thus producing an undesirable moment arm on the user's wrist and forearm. Additionally, I found that the grip design is too small. A user holding Smith's bottle will find the grip extending approximately half way down their palm. I have found, through the testing of common household cleaner spray bottles, that the user's entire palm will be in contact with the bottle while actuating the trigger with their index and middle fingers and holding the bottle with their ring and pinkie finger, in order to effectively control the bottle while actuating the trigger. Manufacturing the grip on Smith's bottle to larger specifications to meet these criteria would vastly increase the size of the spray device and increase production costs. Additionally, the small grip does not lend itself well to comfortably holding the bottle, especially when it is full, at any angle other than straight up.

Wright, in U.S. Pat. No. 5,160,071, "VERTICAL SPRAY BOTTLE NOZZLE", 3 Nov. 1992, discloses another such device. I have found that Wright's spray bottle nozzle, while angling the spray nozzle down, does not allow the user to completely consume the liquid contents of the bottle. Additionally, I found the nozzle is of large size, which would increase production price. I also found, in the case where a user wishes to apply a concentrated liquid spray to a small area on a horizontal surface, the user would find difficulty getting the spray nozzle close to the affected surface to which he desired to apply the liquid.

Ouellette, in U.S. Pat. No. 7,055,722, "SPRAY BOTTLE", 6 Jun. 2006, discloses another such device. I have found that Ouellette's bottle, for the same reason as the aforementioned prior art spray bottle, cannot expend the entirety of the liquid from the bottle, due to the straw losing contact with the liquid at the bottom of the bottle. Additionally, I found that the straw diverter will only bend the flexible straw to an angle parallel the diverter, thus not directing the straw to the bottom of the second chamber when held horizontally with the intent of directing the spray downwards.

OBJECTS, SUMMARY, AND ADVANTAGES OF THE INVENTION

It is an object of the present invention to provide a spray device which can be fitted atop common cleaning fluid bottles, that allows easy application of fluid to horizontal surfaces, by way of inverting the bottle above the spray device.

It is a further object of the present invention to allow complete consumption of the fluid in the bottle.

It is a still further object of the present invention to allow unlimited spraying while inverted.

It is a still further object of the present invention to provide a device that can be effectively and comfortably operated with one hand.

In summary, the invention is a gravity fed spray bottle. The invention generally consists of a liquid spray device, including integrated liquid and air pump assembly, trigger, and nozzle, which can be attached to the opening of common threaded plastic bottles, for the purpose of inverting the bottle so the spray device is on the bottom, where the spray device, whose siphon straw (or liquid entry tube) extends only to the opening of the bottle, can feed the entirety of the liquid in the bottle to the pump assembly, and direct the spray vertically onto a horizontal surface. The nozzle of the spray device is angled similar to the vertical axis of the bottle so when the bottle is inverted, the user sprays the fluid down.

An advantage of the present invention is that it can be operated with one hand.

Another advantage of the present invention is that the liquid is gravity fed to the pump assembly, allowing complete liquid consumption while operated inverted.

A further advantage of the present invention is that the most common direction to which household cleaning solutions are applied, down, is the primary designed spray direction.

A still further advantage of the present invention is that the spray device is of relative size to existing spray bottle spray devices, and uses like parts, and thus minimizes its production costs.

A still further advantage of the present invention is that a user can easily hold and operate the spray bottle, placing their entire palm in contact with the back of the existing bottle neck without any undesirable forces or moments acting upon the user's wrist or forearm. Because the user grips the existing bottle neck, the moment arm of a full bottle is less than gripping the bottle near the opening.

A still further advantage of the present invention is that a user can adjust the direction of spray exiting the bottle with the adjustable nozzle. The user is able to spray a liquid in all directions from vertical to horizontal if so desired, without having to adjust the angle in which the spray bottle is held.

A still further advantage of the present invention is that an air pump assembly, operated when the trigger is actuated or released and returns to its resting position, pumps air into the liquid storage bottle, which replaces the expended liquid and equalizes the pressure in the bottle.

A still further advantage of the present invention is that a user can spray the entire contents of the bottle in the inverted position without having to reposition the bottle upright to relieve pressure.

BRIEF DESCRIPTIONS OF THE DRAWINGS

DETAILED DESCRIPTION OF THE PRIOR ART

Figure 1:
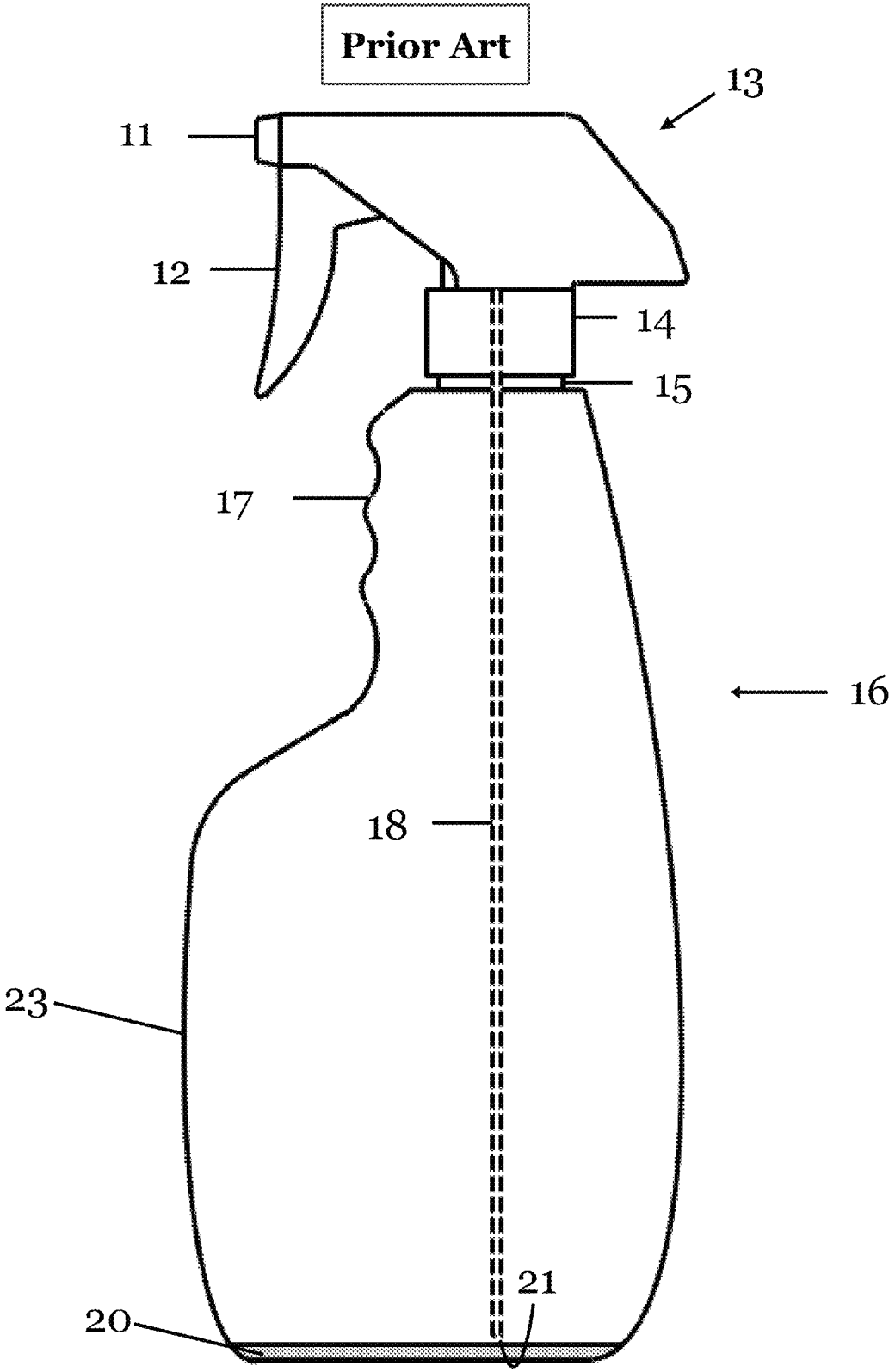
FIG. 1 is a side view of a common prior art spray bottle held vertically to spray a liquid horizontally.

FIG. 1 illustrates a prior art common spray bottle with minimal liquid remaining held vertically, and demonstrates the problem of the user's inability to entirely expend the liquid. The spray device 13, which includes a trigger 12, nozzle 11, siphon straw 18, and internal pump assembly (not drawn), is connected to the bottle's threaded opening 15 by the threaded connector 14. The bottle 16 has molded finger grips 17 and holds liquid 20. To operate, a user grips the bottle 16 towards the top of the bottle wrapping their fingers around the finger grips 17. A user squeezes the trigger 12 with their fingers, which expels liquid residing in the pump assembly (not drawn) within the spray device 13, and the expelled liquid exits the nozzle 11. As the user allows the trigger 12 to reset to its original out position, the pump attempts to draw liquid 20 up through the bottom of the siphon straw 21 to be expelled on subsequent trigger actuations. On subsequent trigger squeezes, the liquid residing in the siphon straw 18 is drawn into the pump assembly residing inside the spray device 13. While the remaining liquid 20 remains in contact with the bottom of the siphon straw 21, this process may continue. However when the liquid 20 remaining in the bottle 16 is depleted enough, the bottom of the siphon straw 21 is no longer in contact with the liquid 20. Air is drawn up through the bottom of the siphon straw 21, and the spray device 13 will spray air. The liquid 20 remaining in the bottle 16 is unusable.

Figure 2:
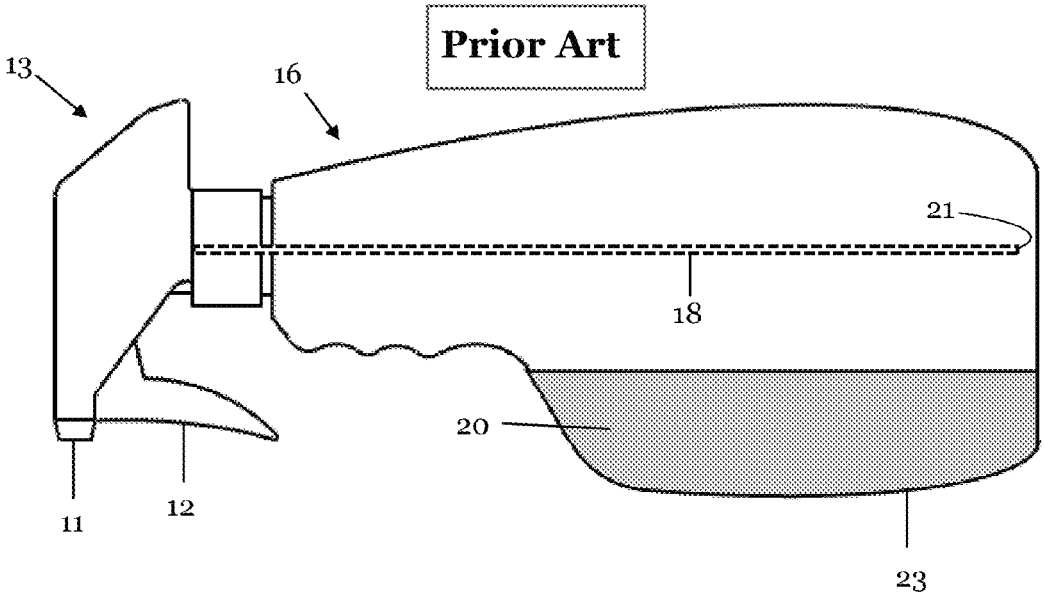
FIG. 2 is a side view of a common prior art spray bottle held horizontally for the intent of spraying a liquid down onto a horizontal surface.

FIG. 2 illustrates when the user holds the prior art spray bottle in a horizontal position, aiming the nozzle down, with the intent to spray the liquid onto a horizontal surface. FIG. 2 demonstrates the problem of the user's inability to spray liquid with the spray bottle positioned horizontally. The liquid 20 is shown as being two thirds consumed. The liquid 20 moves to the low point of the bottle 16 and sits on the surface 23. The bottom of the siphon straw 21 is no longer in contact with the liquid 20. When the user actuates the trigger 12, the siphon straw 18 will draw air, as it is no longer in contact with the liquid 20. The spray device 13 will force air out of the nozzle 11.

Figure 3:
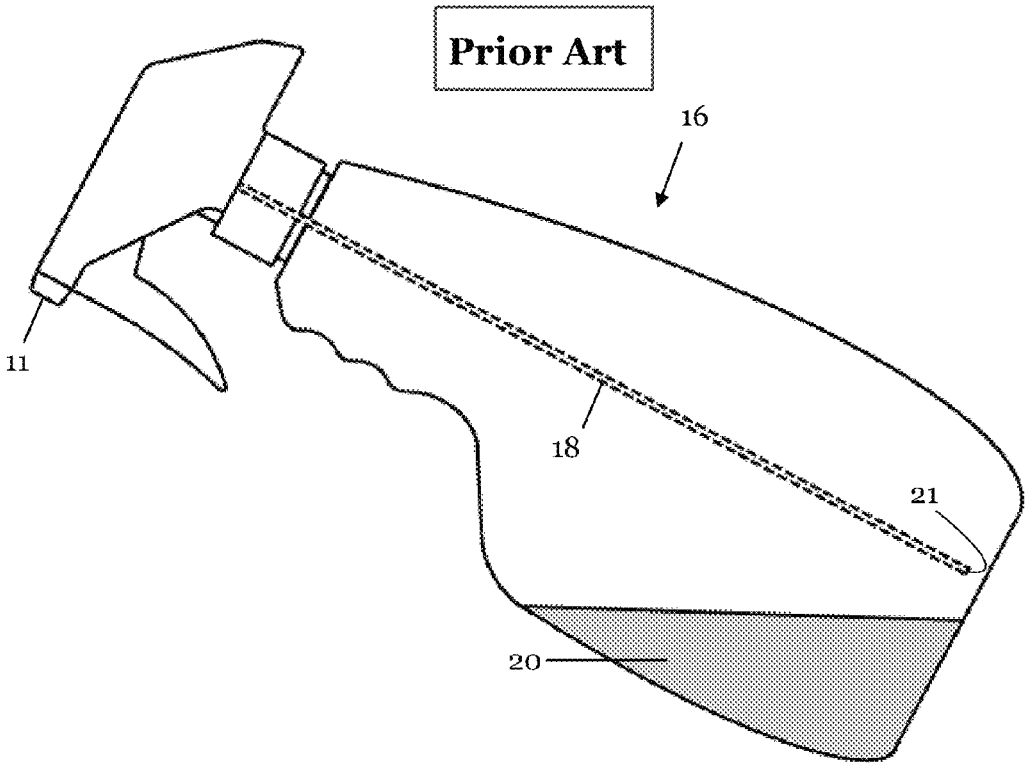
FIG. 3 is a side view of a common prior art spray bottle angled about sixty degrees for the intent of spraying a liquid down onto a horizontal surface.

FIG. 3 illustrates when a user holds the prior art spray bottle at an angle. FIG. 3 demonstrates the same problem as FIG. 2, but where the user may hold the bottle at this angle in an attempt to regain contact between the bottom of the siphon straw 21 and the remaining liquid 20. Angling the bottle 16 any closer to vertical to regain liquid-straw contact may bring the spray expelled from nozzle 11 too far away from the target surface to be effective. At this current orientation, the bottom of the siphon straw 21 continues to remain out of contact with the liquid 20, air is drawn into the straw 18, and air is expelled from nozzle 11.

Both FIG. 2 and FIG. 3 also demonstrate the inability of the user to entirely expend the liquid contents of bottle when attempting to spray the liquid down onto a horizontal surface. The further the liquid is depleted, the less angled the user can orient the spray bottle.

DETAILED DESCRIPTION OF THE INVENTION

Figure 4:
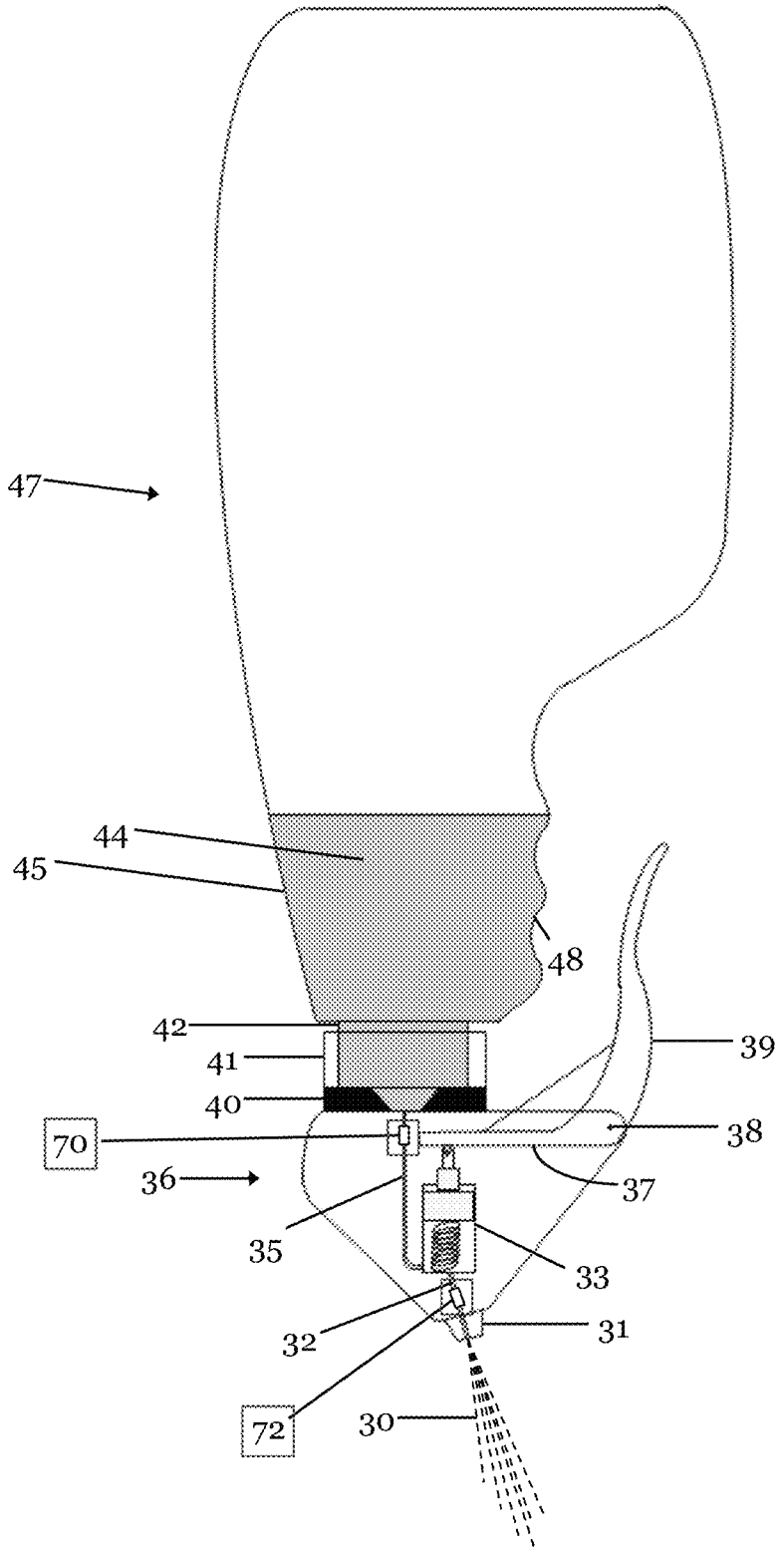
FIG. 4 is a side view illustrating an embodiment of the present invention, where the user holds the bottle inverted to apply the liquid spray down onto a horizontal surface.

FIG. 4 illustrates an embodiment of the present invention, held inverted for the purpose of applying the liquid contents of the bottle to a horizontal surface. The invention generally comprises a liquid spray device 36 connected to a common liquid storage bottle 47. The liquid spray device 36 comprises a molded shell housing, a liquid entry tube 35 connected to a liquid pump assembly 33, connected to a liquid exit tube 32, and capped with a nozzle 31. Hinged to the spray device at a pivot point 38 is a trigger 39. The pivot point 38 is positioned at the lateral front edge of the liquid spray device 36 so the trigger 39 extends out in front of the user's hand when gripping the spray bottle. A force arm 37 portion of the trigger is in contact with a piston of the pump assembly 33. The spray device 36 connects to the bottle 47 at a connection point with a threaded cap 41 common to prior art spray bottles. Ensuring a water-tight seal is a gasket 40 which is positioned between a threaded bottle opening 42 and the threaded cap 41. The open end of entry tube 35 extends through the gasket 40 and remains uncovered by the gasket 40. The bottle 47 has molded finger grips 48, a neck 45, and holds a liquid 44. Gravity ensures the liquid 44 maintains contact with the opening of the liquid entry tube 35 while in the inverted position The bottle body 47 is the same as the prior art bottle body illustrated in FIGS. 1, 2, and 3.

To operate the present invention, the user positions the bottle 47 inverted and grips the neck 45 of the bottle 47 with their index finger wrapped around the top of the finger grips 48, and their palm in contact with the opposite side of the bottle neck 45. The user grips the trigger 39 with their middle, ring, and pinkie fingers and squeezes. The force arm 37 pushes the piston in the pump assembly 33. Liquid residing in the pump assembly 33 is expelled as a spray 30 through the liquid exit tube 32 and nozzle 31 down towards the target horizontal surface. Upon trigger release, the liquid 44 residing in the bottle 47 is siphoned into the pump assembly 33 as the piston retracts. A one way check valve 70 in the liquid entry tube ensures that pressure is maintained in the pump assembly during trigger actuation. Another one way check valve 72 in the liquid exit tube 32 ensures that no air enters the pump assembly via the nozzle as the trigger retracts.

This embodiment of the present invention also includes several elements to increase the user's comfort and control. A user grips the bottle 47 by supporting the weight of the bottle 47 with their thumb and index finger. A user grips their thumb and index finger at the vertical point on the bottle 47 where the finger grips 48 meet the widening bottle body. The moment arm induced by holding the bottle 47 at any angle other than pure vertical is minimized due to the user supporting the bottle's weight near the middle of the bottle. This offers the user comfortable control of the bottle 47. Additionally, the pivot point 38 to which the trigger 39 connects extends laterally beyond the vertical line drawn down the front of the finger grips 48. When the trigger 39 is pulled, the trigger moves in a circular motion, initially in the direction of the hand grips 48 and then with a slight downward motion towards the nozzle (counter-clockwise in FIG. 4). I have found this motion (in and slightly down) to be the most comfortable and natural way in which to squeeze a trigger with the index, middle, and ring fingers.

Figure 5:
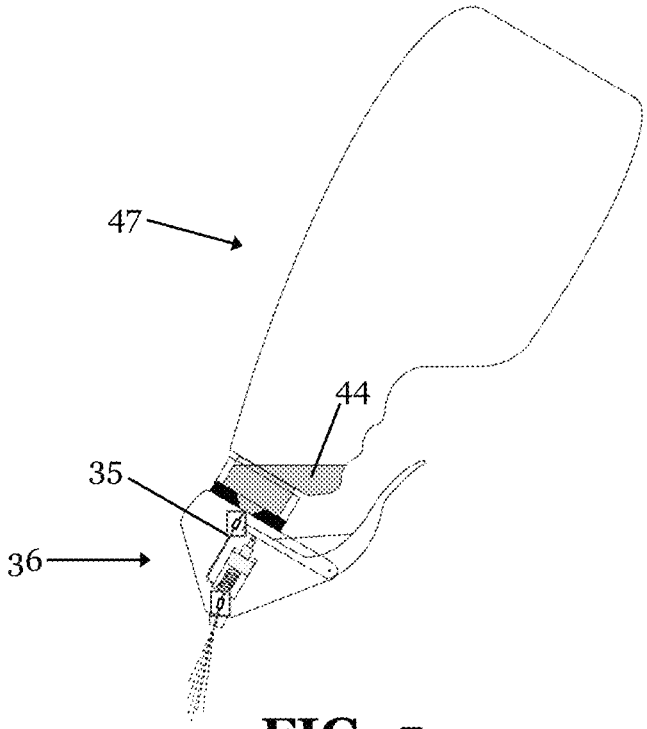
FIG. 5 is a side view illustrating an embodiment of the present invention, where the user holds the bottle inverted at a slight angle to apply the liquid spray down onto a horizontal surface.

FIG. 5 illustrates an embodiment of the present invention held inverted at an angle for the purpose of applying the liquid to a horizontal surface. The approximate angle may be a natural wrist position for a user to hold said bottle when applying the liquid to a horizontal surface close to the user's body. FIG. 5 demonstrates that the liquid 44 inside bottle 47 will remain in contact with the liquid entry tube 35, allowing the spray device 36 to apply the liquid 44 to a horizontal surface.

Figure 6:
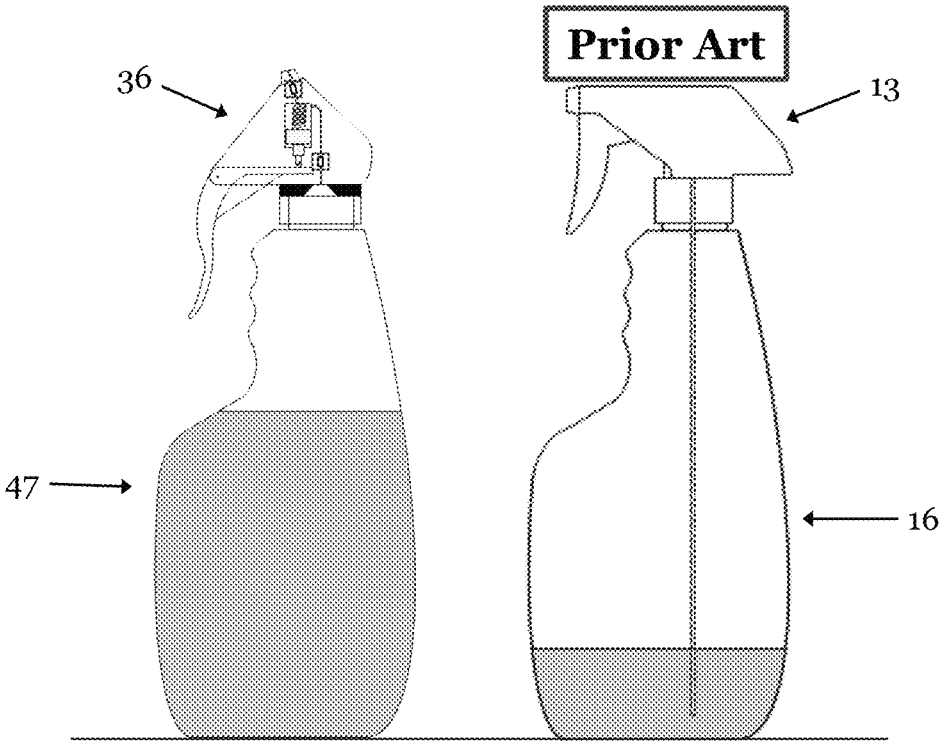
FIG. 6 is a side view illustrating an embodiment of the present invention, where the user stores the bottle upright sitting on a horizontal surface (shelf, cabinet, etc.) while not in use, next to a common prior art spray bottle.

FIG. 6 illustrates an embodiment of the present invention next to the prior art spray bottle, both sitting vertically in storage. The relative size of the preferred embodiment of the spray device is equal to common store bought spray devices. When the bottle 47/spray device 36 is placed in storage right side up on a horizontal surface, the present invention will occupy approximately the same space as a common spray bottle 16/spray device 13.

Figure 7:
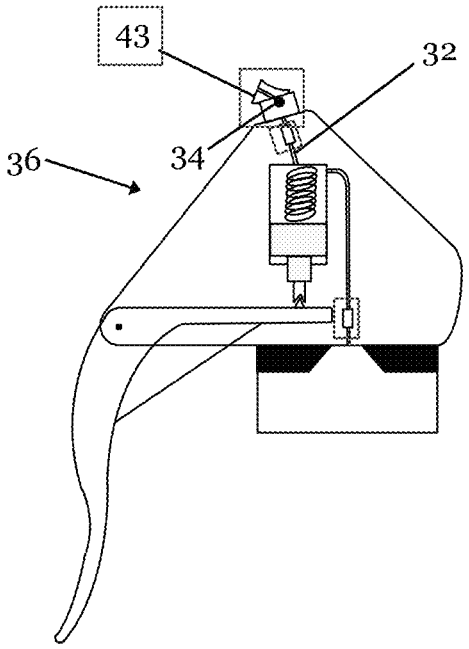
FIG. 7 is a side view illustrating an embodiment of the spray device of the present invention, where the spray device utilizes a variable angle nozzle to be adjusted by the user to aim the spray from straight vertical through horizontal.

FIG. 7 illustrates an embodiment of the spray device of the present invention with a user manipulated variable angle nozzle. Exit tube 32 runs through the spray device 36 to the variable angle nozzle 43. The variable angle nozzle 43 is attached to the spray device 36 by a hinge 34. The variable angle nozzle 43 is shown with a concave shape to allow the user to easily manipulate the nozzle 43 with their thumb and index finger. The variable angle nozzle can rotate plus or minus approximately 90 degrees for instances where the user may want to direct the liquid spray horizontally or at any angle between horizontal and pure vertical.

Figure 8:
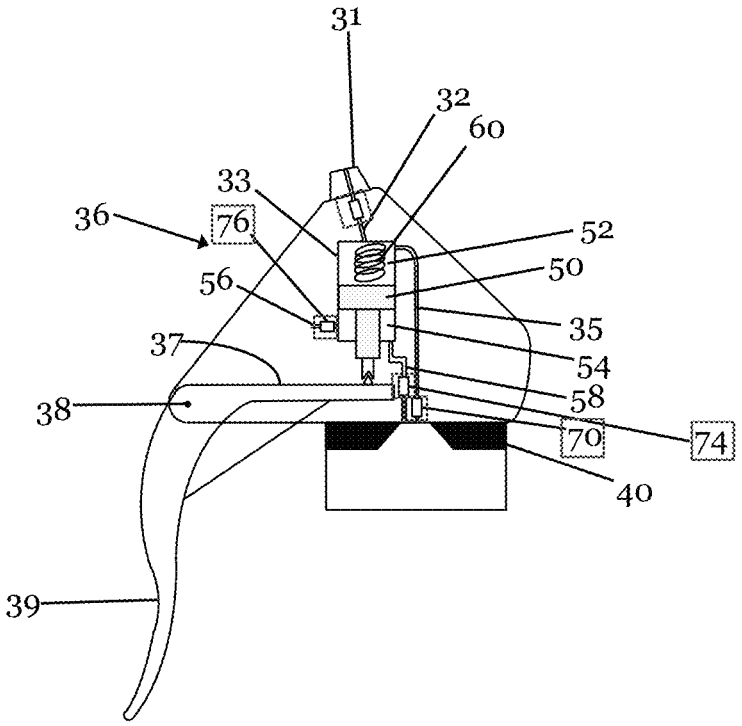
FIG. 8 is a side view illustrating an embodiment of the spray device of the present invention, where an air reservoir/pump assembly, housed within the spray device, is actuated when releasing the trigger to force air into the bottle to equalize the pressure and avoid a vacuum.

FIG. 8 illustrates an embodiment of the spray device of the present invention with an air pump assembly coupled to the liquid pump assembly. The trigger 39, attached to the spray device 36 at hinge 38, is contiguous with the force arm 37. Force arm 37 contacts the piston 50. The liquid reservoir 52 is contiguous with the air reservoir 54 as they are one hollow tube separated by the piston 50. A spring 60 is attached to the top of the liquid reservoir 52 and the piston 50. The liquid entry tube 35 runs from the bottom of the spray device 36 at the gasket 40 to the liquid reservoir 52, with a one way check valve 70 along its length. The liquid exit tube 32 runs from the liquid reservoir 52 to the nozzle 31, with a one way check valve 72 along its length. The air reservoir 54 is on the opposite side of the piston 50. The air entry tube 56, with an open end outside the air reservoir 54 in communication with ambient air, connects to the air reservoir 54 via a one way check valve 76. The air exit tube 58 connects to the air reservoir 54 and extends to the bottom of the spray device 36 at the gasket 40. A one way check valve 74 resides along the air exit tube 58. When the user actuates the trigger 39, the force arm 37 pushes the piston 50 into the liquid reservoir 52 forcing liquid out the liquid exit tube 32 through the nozzle 31. This action also pulls air from the air entry tube 56 into the air reservoir 54. When the trigger 39 is released by the user, the spring 60 forces the piston 50 towards the force arm 37. This action pulls liquid back into the liquid reservoir 52 by increasing its volume. This action also forces the piston 50 to push air from the air reservoir 54 out the air exit tube 58 into the spray bottle (not shown), by decreasing its volume, to replace the volume of depleted liquid and equalize the pressure in the spray bottle. This function can also be accomplished with different configurations of an air pump assembly (not contiguous with the liquid pump assembly).

Figure 9:
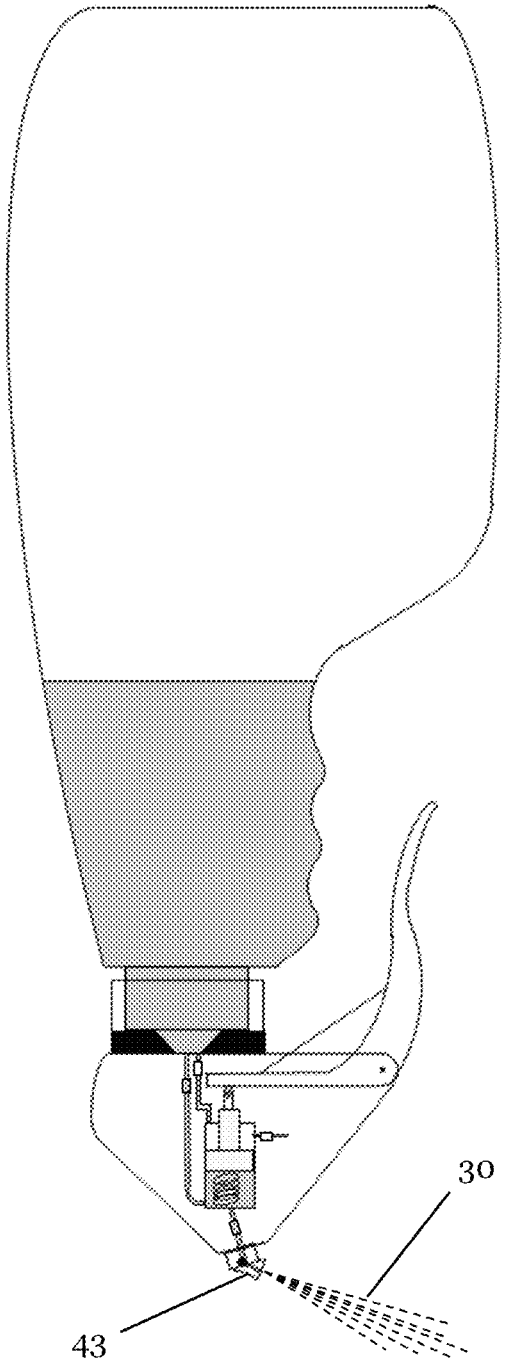
FIG. 9 is a side view illustrating an embodiment of the present invention incorporating the variable angle nozzle and air reservoir/pump assembly, where the user holds the bottle inverted at a slight angle to apply the liquid spray down onto a horizontal surface.

FIG. 9 illustrates an embodiment of the present invention, with the spray device incorporating the air pump assembly and user adjusted variable angle nozzle, held inverted by the user. The user adjusted variable angle nozzle 43 is shown spraying the liquid 30 at an approximate sixty degree angle, however the variable angle nozzle 43 is capable of being set by the user at all angles between pure vertical and horizontal. This is an ideal configuration to capitalize on the present invention's multiple features.

CONCLUSION AND SCOPE

The reader will see that an embodiment of the vertical spray bottle provides a user with the ability to:

- easily apply a liquid spray down onto a horizontal surface
- consume the entire liquid contents of the bottle
- hold and operate the spray bottle with comfort and control with one hand
- equalize the pressure in the bottle allowing continuous use in the intended inverted position The scope of the vertical spray bottle is not to be limited by the specifications illustrated. Many other variations are possible. For example, the preferred embodiment of the spray device and trigger will be made of molded plastic, but can be made of any lightweight material. Additionally, the spray device can be formed into any shape, and the orientation of internal parts altered, such that the specified advantages of the spray device are maintained.

I claim:

1. A hand held liquid spray bottle for the downward application of a spray, comprising:

- a liquid storage bottle to hold a liquid desired to be sprayed by a user, said bottle comprising an opening at an end of said bottle, and a connection point at said opening;
- a liquid spray device, having a connection point, comprising a means to physically expel said liquid from said bottle by said user, and a means to physically force a volume of air into said liquid storage bottle by said user;

a means for joining said liquid spray device to said liquid storage bottle at said connection points;

a trigger, connected to said liquid spray device, to be actuated by a human hand;

a liquid and air pump assembly, contained within said liquid spray device, comprising a cylinder with a liquid reservoir and an air reservoir on opposite sides of a piston; said piston connected to an internally biased spring; said piston contiguous with said trigger; comprising the means to spray a volume of liquid out of said liquid spray device and a volume of air in to said liquid storage bottle; a liquid entry tube extending from said liquid reservoir and terminating with an open end at said connection point, such that said open end of said liquid entry tube is in contact with a liquid in said liquid storage bottle when said liquid storage bottle is joined to said liquid spray device and said liquid storage bottle is held inverted, wherein said liquid reservoir is in fluid communication with said liquid in said liquid storage bottle; said air reservoir comprising an air entry tube that fluidly connects ambient air to said air reservoir; comprising an air exit tube that fluidly connects said air reservoir to said liquid storage bottle when said liquid spray device is joined to said liquid storage bottle; whereby an actuation cycle of said trigger, including a reset action from said spring, will expel said liquid from said liquid reservoir, draw ambient air into said air reservoir, draw said liquid from said liquid storage bottle into said liquid reservoir, and force said air in said air reservoir into said liquid storage bottle to equalize a pressure in said bottle;

a nozzle, fluidly connected to said liquid reservoir in said liquid spray device by a liquid exit tube, angled to spray said liquid at an approximate downward angle when said liquid storage bottle and said liquid spray device are joined and held inverted by said user with said bottle above said spray device;

one-way check valves fluidly connected to said liquid entry tube, said liquid exit tube, said air entry tube, and said air exit tube, facilitating the proper operation of said liquid and air pump assembly.

2. The liquid spray bottle of claim 1 wherein said liquid storage bottle and said liquid spray device are rotationally connected at a threaded connection point.

3. The liquid spray bottle of claim 1 wherein said liquid storage bottle has molded finger grips.

4. The liquid spray bottle of claim 1 wherein said trigger, used for said liquid and air pump assembly actuation, is pivotally connected to said liquid spray device at a pivot point at a lateral front edge of said liquid spray device, wherein said trigger is approximately parallel to a longitudinal axis of said liquid storage bottle and positioned laterally beyond a user's fingers when gripping said liquid spray bottle.

5. The liquid spray bottle of claim 1 wherein said nozzle is pivotally connected to said liquid spray device such that a user can adjust an angle of said nozzle to alter said angle of a spray exiting from said liquid spray bottle.

6. The liquid spray bottle of claim 1 wherein said trigger, used for said liquid pump assembly and said air pump assembly actuation, is rotationally connected to said liquid spray device, and is of a length wherein a human hand can grip said trigger with the middle, ring, and pinkie fingers, and wherein said human's index finger and palm can grip said liquid storage bottle without said trigger contacting said index finger during trigger actuation.

7. The liquid spray bottle of claim 1 wherein a gasket is connected to said liquid spray device at said connection point, providing a liquid and air tight seal when said liquid storage bottle is joined to said liquid spray device, wherein said open end of said liquid entry tube passes through said gasket and extends approximately no further than a bottom edge of said gasket; wherein said air exit tube passes through said gasket.

* * * * *